US006201377B1

(12) United States Patent
Sauer

(10) Patent No.: US 6,201,377 B1
(45) Date of Patent: Mar. 13, 2001

(54) MATCH-INSENSITIVE LOW-CURRENT BIAS CIRCUIT

(75) Inventor: Don R. Sauer, San Jose, CA (US)

(73) Assignee: National Semiconductor Corp., Santa Clara, CA (US)

( * ) Notice: Subject to any disclaimer, the term of this patent is extended or adjusted under 35 U.S.C. 154(b) by 0 days.

(21) Appl. No.: 09/239,605

(22) Filed: Jan. 29, 1999

(51) Int. Cl.[7] ..... G05F 3/20
(52) U.S. Cl. ..... 323/313; 327/538
(58) Field of Search ..... 323/312, 313, 323/315; 327/539, 576, 538

(56) References Cited

U.S. PATENT DOCUMENTS 3,979,688 * 9/1976 Maidique ..... 330/38 M
4,461,992 * 7/1984 Yamaguchi et al. ..... 323/313
4,574,251 * 3/1986 Jason ..... 330/279

OTHER PUBLICATIONS

Product Summary: "Strain–gauge amp has high gain", by John Christensen, National Semiconductor, Santa Clara, California, date unknown, one page.*

"Precision op amp shrugs off problem of Y2K—and beyond", Fran Granville, EDN Leading Egde, Sep. 24, 1998, p. 11.*

"Microelectronic Circuits", Second Edition, Adel S. Sedra and Kenneth C. Smith, Holt, Rinhart and Winston, date unknown, pp. 512–113.*

"Intuitive IC Electronics", Second Edition, Thomas M. Frederiksen, McGraw–Hill Publishing Company, date unknown, pp. 97–99.*

"Analysis and Design of Analog Integrated Circuits", Third Edition, Paul R. Gray, Robert G. Meyer, John Wiley & Sons, Inc., date unknown, pp. 346–347.*

* cited by examiner

*Primary Examiner*—Jessica Han
(74) *Attorney, Agent, or Firm*—Skjerven, Morrill MacPherson LLP; Patrick D. Benedicto

(57) ABSTRACT

A match-insensitive low current bias circuit uses a transistor arrangement which takes advantage of the transistors' collector current degeneration, current gain through emitter sizing, and voltage gain to minimize any errors caused by stage mismatches created during production. The bias circuit of the present invention is particularly suited to integrated circuit applications where a low biasing current is required.

11 Claims, 3 Drawing Sheets

| | A | B | C |
|---|---|---|---|
| 1 | Isat | =10^–29*(B3–273)^8 | Saturation Current |
| 2 | Temp_C27 | 27 | Temperature in degrees Centigrade |
| 3 | T | =B2+273 | Temperature in degrees Kelvin |
| 4 | Vt | =0.026*B3/300 | Thermal Voltage |
| 5 | | | |
| 6 | R_Bias | =26*10^3 | Reference Current Defining Resistor |
| 7 | I_Bias | =2*B4/B6 | Input Bias Current |
| 8 | | | |
| 9 | | | |
| 10 | Ic5 | =B7*B31–B16 | Collector current through Q5 |
| 11 | Q5_Area | =1*B32 | Emitter Area of Q5 |
| 12 | Vbe5 | =B4LN(B10/(B1*B11)) | Base to Emitter voltage of Q5 |
| 13 | | | |
| 14 | Q6_Area | =10*B33 | Emitter Area of Q6 |
| 15 | R3 | =B34*60*10^3 | Emitter resistor of Q6 |
| 16 | Ic6 | =IF(B29=0,B10, B16–B16*B19) | Collector current of Q6 |
| 17 | V2 | =B15*B16 | Voltage on the emitter of Q6 |
| 18 | Vbe_Test | =B4*LN(B16/ (B1*B14))+B17 | Vbe resulting from value in cell B16 |
| 19 | Guess_Error | =B18–B12 | Error used to correct the value of B16 |
| 20 | | | |
| 21 | R4 | =B35*180*10^3 | Collector resistor of Q6 |
| 22 | Vbe3 | =B12–B21*B16 | Base to Emitter voltage of Q6 |
| 23 | Iout | =B1*EXP(B22/B4) | Output Current. Also, collector current of Q7 |
| 24 | I_Desired | =B7/2000 | Desire output current |
| 25 | I3_Error% | =1–B23/B24 | Percent error |
| 26 | | | |
| 27 | | | |
| 28 | | | |
| 29 | Run_@_1 | 1 | To calculate values, enter a "0" then a "1" |
| 30 | | | |
| 31 | Ibias_Factor | 1 | Perfect value = 1.00, 4% error = 1.04, etc. |
| 32 | Area_Q5_factor | 1 | Perfect value = 1.00, 4% error = 1.04, etc. |
| 33 | Area_Q6_Factor | 1 | Perfect value = 1.00, 4% error = 1.04, etc. |
| 34 | R3_Factor | 1 | Perfect value = 1.00, 4% error = 1.04, etc. |
| 35 | R4_Factor | 1 | Perfect value = 1.00, 4% error = 1.04, etc. |

Fig. 3

MATCH-INSENSITIVE LOW-CURRENT BIAS CIRCUIT

BACKGROUND OF THE INVENTION

1. Field of the Invention

The present invention relates to low current bias circuits. In particular, the present invention relates to low bias current sources in integrated circuit applications.

2. Description of the Related Art

Biasing techniques which are used in discrete circuit applications are not normally suited for use in integrated circuits. In an integrated circuit ("IC"), large resistors and capacitors are more difficult to manufacture than transistors. Consequently, IC designers have devised biasing techniques which use transistors wherever possible. In an IC, a constant current is often generated at one location and is distributed throughout the IC using current mirrors and steering circuits.

Biasing in IC design is often based on the well-known bandgap reference. A bandgap reference circuit takes advantage of a very stable delta base-to-emitter voltage ($V_{BE}$) between two conducting bipolar junction transistor ("BJT") to provide a constant current, which is then used as a reference current. In one such reference current, the voltage difference ($\Delta V_{BE}$, typically approximately 60 mV) between two bipolar transistors' $V_{BE}$'s are applied across a known resistance to create a reference current. The reference current is then scaled by bias circuits to bias other circuits in the IC. To ensure that the reference current is stable across the integrated circuit, the bias circuits are fabricated within a set of tolerance and specifications matching those of the bandgap reference. For example, a bias circuit designed to operate with a 2 uA current source must be coupled to a bandgap reference which can accurately provide such a current.

In general, transistors fabricated on the same substrate can have matched characteristics which track changes in both the fabrication process and operating parameters (e.g., temperature). Manufacturing tolerances and design tolerances determine how closely circuits can be matched. If the design is sensitive to mismatches, manufacturing tolerance must be tightened. Otherwise, low production yield and device reliability would result. Circuit matching becomes more critical as bias currents reach the sub-nanoampere level, which is required in today's power devices.

The following equation relates in a BJT a change in voltage $V_{BE}$ to a change in collector current:

$$\frac{I_{new}}{I_{old}} = e^{\frac{\Delta V_{BE}}{V_T}} \tag{1}$$

where $I_{old}$ and $I_{new}$ are the collector currents of a BJT before and after an increase of $\Delta V_{BE}$ in voltage $V_{BE}$; and $V_T$ (~26 mV) is the thermal voltage. Equation (1) can be rewritten as:

$$\Delta V_{BE} = V_T \ln \frac{I_{new}}{I_{old}} \tag{2}$$

Thus, equation (1) provides that a 60 mV change in $V_{BE}$ results in a ten-fold increase in collector current. Similarly, equation (2) provides that an 8% change in collector current results in a 2 mV change in $V_{BE}$.

A low-current bias circuit 100 in the prior art is shown in FIG. 1. As shown in FIG. 1, circuit 100 includes transistors $Q_8$ and $Q_9$ of equal size, and resistor $R_5$ (180 KΩ) coupled between an output terminal of current source 101 (which has a current $I_{source}$ of 1 $\mu$A) and the collector terminal ($V_5$) of transistor $Q_8$. The base terminal of transistor $Q_8$ is also coupled to the output terminal of current source 101. The base terminal of transistor $Q_9$ is coupled to collector terminal ($V_5$) of transistor $Q_8$. The collector terminal of transistor $Q_9$ is coupled to the circuit intended to be biased.

For our purpose, the base current of a BJT is negligible relative to the collector current. Thus, collector current $I_{c8}$ of transistor $Q_8$ is equal to current $I_{source}$ of current source 101. Since resistor $R_5$ provides a voltage drop of 180 mV from supply voltage $V_{CC}$, the $V_{BE}$ of transistor $Q_8$ exceeds the $V_{BE}$ of transistor $Q_9$ by 180 mV, thus output current $I_{out}$ of transistor $Q_9$ is approximately 1 nA, as provided by equation (1) above (i.e. $I_{out}=10^{-6}*e^{-180/26}=0.984*10^{-9}$). Circuit 100 can thus be used to supply a low bias current in an IC. Also, if circuit 100 is fabricated on the same substrate as the bandgap reference circuit which provides current source 101, circuit 100 tracks the bandgap reference over variations in fabrication process and temperature.

Circuit 100, however, is sensitive to circuit mismatches. For example, if the resistance of resistor $R_5$ is lowered by 10% due to a variation in the fabrication process, the voltage across resistor $R_5$ decreases by 18 mV, which causes an increase of the same magnitude in the $V_{BE}$ voltage of transistor $Q_9$. Consequently, the output current $I_{out}$ of transistor $Q_9$ doubles. Thus, a 10% change in resistor $R_5$ results in a 100% increase in output current $I_{out}$. Clearly, such match-sensitivity does not meet today's production yield and device reliability requirements.

Thus, a need for a low-current bias circuit that is relatively insensitive to circuit mismatches is desired.

SUMMARY OF THE INVENTION

The present invention provides a low-current bias circuit which is relatively insensitive to circuit mismatches. In one embodiment, a circuit of the present invention combines the effects of current degeneration, current gain, and voltage gain to minimize any errors caused by circuit mismatches created during fabrication.

BRIEF DESCRIPTION OF THE DRAWINGS

The present invention may be better understood, and its numerous objects, features, and advantages made apparent to those skilled in the art by referencing the accompanying drawings.

FIG. 3 shows a spreadsheet for selecting component values in one embodiment.

DESCRIPTION OF THE PREFERRED EMBODIMENTS

To facilitate comparison between elements of the various figures, and to simplify the detailed description below, like elements in the various figures are provided like reference symbols or numerals.

Figure 2A:
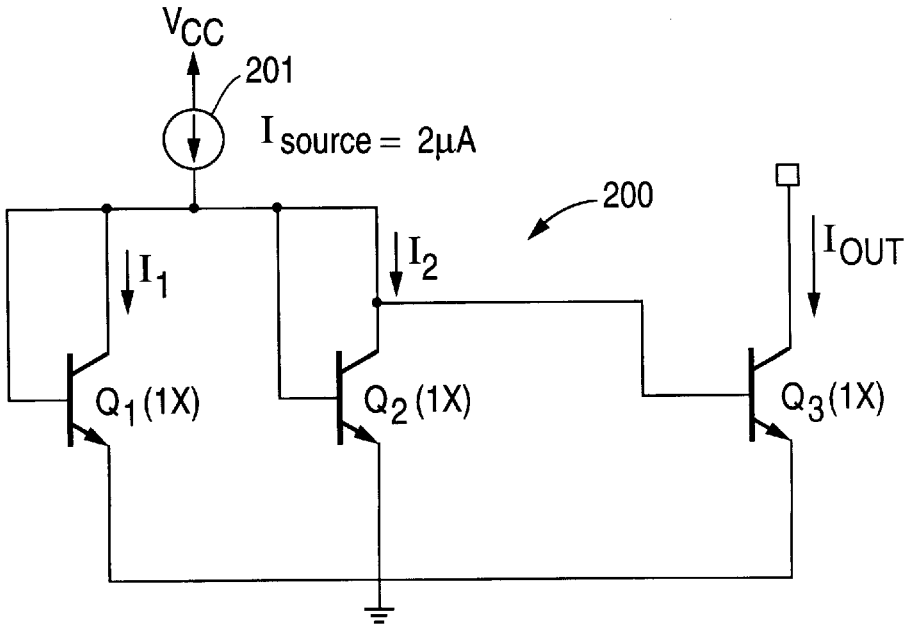
FIGS. 2*a* to 2*b* show current bias circuits 200 and 250, which illustrate different aspects of a circuit of the present invention.

FIG. 2*a* shows a current bias circuit 200. Current bias circuit 200 includes transistors $Q_1$, $Q_2$ and $Q_3$ of equal size, and a current source 201. Current source 201 is coupled between supply voltage $V_{CC}$ and the commonly-connected collector and base terminals of transistors $Q_1$ and $Q_2$. The base terminal of transistor $Q_3$ is coupled to the collector terminal of transistor $Q_2$, and the collector terminal of transistor $Q_3$ is coupled to supply voltage $V_{CC}$. The emitter terminals of transistors $Q_1$, $Q_2$, and $Q_3$ are coupled to a ground voltage reference.

In circuit 200, since transistors $Q_1$ and $Q_2$ have the same size, and their respective $V_{BE}$'s are the same, the current $I_{source}$ (~2 $\mu$A) of current source 201 is equally divided between the respective collector currents $I_1$ and $I_2$ of transistors $Q_1$ and $Q_2$. (For our purpose, the base current of a BJT is negligible relative to the collector current). Thus, collector current $I_2$ of transistor $Q_2$ is approximately 1 uA. Since transistor $Q_3$ mirrors the current of transistor $Q_2$, collector current $I_{out}$ of transistor $Q_3$ also equals 1 uA.

Figure 2B:
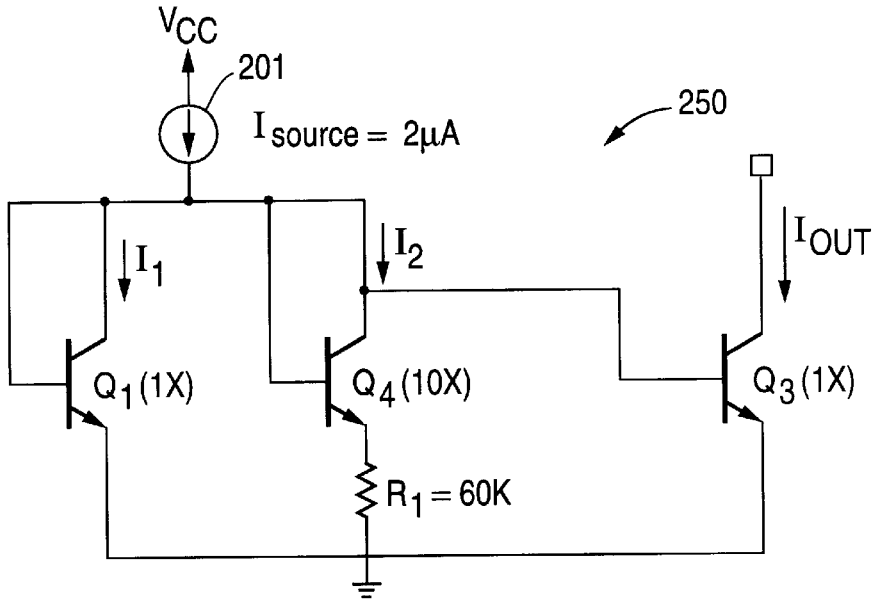

Circuit 250 of FIG. 2*b* is substantially the same as circuit 200 of FIG. 2*a,* except that transistor $Q_2$ of circuit 200 is replaced in circuit 250 by transistor $Q_4$, which is 10 times the size of transistor $Q_1$; also, resistor $R_1$ (60 KΩ) is present in circuit 250. Resistor $R_1$ is coupled between the emitter terminal of transistor $Q_4$ and the ground reference. The size of transistor $Q_4$ and the resistance of resistor $R_1$ are selected so that collector current $I_2$ remains at approximately 1 uA. As can be seen from equation (1), a decrease of 60 mV in $V_{BE}$ of transistor $Q_4$ results in a 10-fold decrease in $I_2$, thus transistor $Q_4$ is sized to be 10 times the size of transistor $Q_1$ to offset the decrease in $V_{BE}$ in transistor $Q_4$. Thus, the resistance of resistor $R_1$ is selected to be 60 KΩ, to result in a voltage drop of approximately 60 mV. Since transistor $Q_3$ mirrors the current of transistor $Q_4$, the collector current $I_{out}$ of transistor $Q_3$ remains at 1 uA.

Figure 2C:
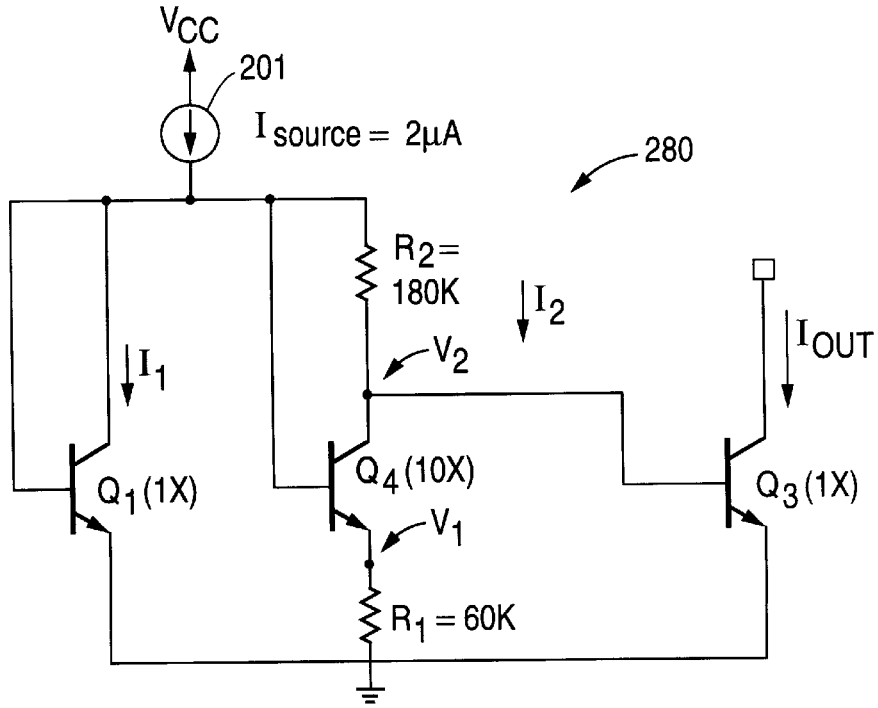
FIG. 2*c* shows a circuit 280, which is an embodiment of the present invention.

FIG. 2C shows circuit 280, which is an embodiment of the present invention. Circuit 280 is substantially the same as circuit 250 of FIG. 2*b,* except that a 180 KΩ resistor R2 is coupled between the output terminal of current source 201 and the collector terminal of transistor $Q_4$. Since collector current $I_2$ of transistor $Q_4$ is 1 uA, the voltage across R2 is 180 mV. Consequently, the $V_{BE}$ of transistor $Q_3$ is 180 mV less than the $V_{BE}$ of transistor $Q_4$, so that a 1000 times decrease in the collector current $I_{out}$ of transistor $Q_3$ results. In this case, current $I_{out}$ becomes approximately 1 nA (1 uA/1000). Thus, circuit 280 of FIG. 2C provides a 1 nA bias current.

Figure 1:
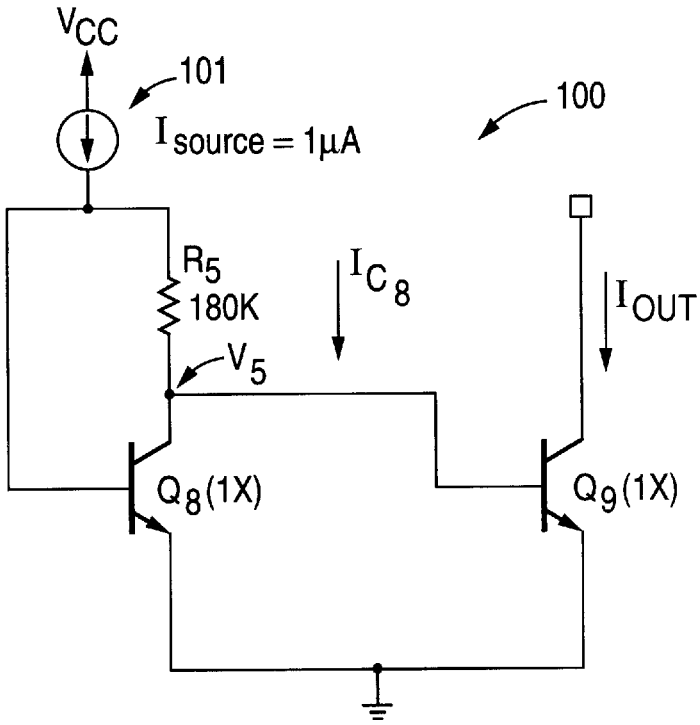
Fig. 1 (PRIOR ART)
FIG. 1 shows a current bias circuit 100 in the prior art.

Low-current bias circuit 280 is relatively insensitive to circuit mismatches. For example, if the current $I_{source}$ of current source 201 is 8% lower than 2 uA, an 8% change in collector current $I_1$ of transistor $Q_1$ results, which represents a 2 mV decrease in $V_{BE}$ for transistor $Q_1$, according to equation (2) above. Since the $V_{BE}$ of transistor $Q_1$ is equal to the $V_{BE}$ of transistor $Q_4$ plus the voltage drop $V_1$ across resistor $R_1$, the 2 mV decrease in $V_{BE}$ of transistor $Q_1$ is divided between the $V_{BE}$ of transistor $Q_4$ and the voltage drop across resistor $R_1$. Thus, in this example, because of $R_1$'s resistance and the size and the gain of transistor $Q_4$, a decrease of 1 mV each is seen in the $V_{BE}$ of transistor $Q_4$ and the voltage across resistor $R_1$, and a net increase of 1 mV is seen at the collector terminal $V_2$ of transistor $Q_4$, which is coupled to the base terminal of transistor $Q_3$. Thus, the $V_{BE}$ of transistor $Q_3$ is also increased by 1 mV, which results in a 4% increase in output current $I_{out}$ of transistor $Q_3$. Therefore, unlike a prior art circuit (e.g., circuit 100 of FIG. 1), which output current $I_{out}$ varies by 100% for a 10% decrease in reference current $I_{source}$, circuit 280 of FIG. 2C provides a much more stable output current.

The component values shown for circuit 280 of FIG. 2C are chosen for illustration purposes only. For any given application, components values and device ratios are chosen according to the invention illustrated above, and the constraints then prevailing. Component values can be affected, for example, by available die space and tolerance limits.

To select component values for circuit 280 of FIG. 2*c,* a designer would first set the most constricted parameter. In this case, the output and source currents are likely to be chosen first. The resistance of resistor $R_2$ is then selected to provide a $V_{BE}$ of transistor $Q_3$ that would produce the desired output current. Initially, resistor $R_1$ is selected to provide transistor $Q_4$ a voltage gain of 3. For example, the resistance of resistor $R_1$ is selected to be 60 KΩ, if resistor $R_2$ is selected to be 180 KΩ. The size of transistor $Q_4$ can then be selected such that the resulting current gain from transistor $Q_1$ offsets the degeneration which results from the voltage drop across resistor $R_1$, so as to result in substantially the same collector currents in transistors $Q_1$ and $Q_4$. For example, transistor $Q_4$ is made 10 times larger than transistor $Q_1$, if resistor $R_1$ is selected to be 60 KΩ and the expected collector current in transistor $Q_4$ is 1 uA. Similarly, transistor $Q_4$ can be made 100 times larger than transistor $Q_1$ if resistor $R_1$ is selected to be 120 KΩ and the expected collector current of transistor $Q_4$ is 1 uA.

After initial component values are selected, the designer can then adjust the component values to match specific requirements or design changes. For example, if output current $I_{out}$ is adjusted, resistor $R_2$ is adjusted such that the degeneration on the $V_{BE}$ of transistor $Q_3$ produces the desired output current. The resistance of resistor $R_1$ and the size of transistor $Q_4$ are then accordingly adjusted. Computer-aided design software is available to assist in the design process. For example, circuit simulation program SPICE and Microsoft Excel spreadsheets can be used. The use of computerized design tools is advantageous, since transcendental equations are often involved which solutions are obtained using numerical methods. Further, the interdependence of component values requires all values adjusted to be consistent with each other. FIG. 3 shows a sample Microsoft Excel ver. 5.0a spreadsheet which can be used to select component values for circuit 280 of FIG. 2*c*.

The above detailed description is provided to illustrate the specific embodiments of the present invention and is not intended to be limiting. Numerous variations and modifications within the scope of the present invention are possible. The present invention is set forth in the following claims.

What is claimed is:

1. A low current bias circuit comprising:

a first transistor having an emitter, a base, and a collector, the base of said first transistor being coupled to the collector of said first transistor;

a second transistor having an emitter, a base, and a collector, the base of said second transistor being coupled to the collector of said first transistor, the emitter area of said second transistor being larger than the emitter area of said first transistor;

a first resistor having a first end and a second end, the first end of said first resistor being coupled to the emitter of said second transistor, the second end of said first resistor being coupled to the emitter of said first transistor; and a second resistor having a first end and a second end, the first end of said second resistor being coupled to the collector of said second transistor, the second end of said second resistor being coupled to the base of said second transistor;

whereby the current through the collector of said second transistor is substantially the same as the current through the collector of said first transistor.

2. The bias circuit of claim 1 wherein the emitter area of said second transistor is larger than the emitter area of said first transistor by a factor which offsets the degeneration brought about by the first resistor.

3. The bias circuit of claim 1 further comprising a current source coupled to the second end of said second resistor, wherein the amount of current supplied by said current source is approximately equal to the sum of the collector currents of said first and second transistors.

4. The bias circuit of claim 1 further comprising a third transistor having an emitter, a base, and a collector, the base of said third transistor being coupled to the first end of said second resistor, the emitter of said third transistor being coupled to the second end of said first resistor, the current through the collector of said third transistor being a fraction of the current through the collector of said second transistor.

5. The bias circuit of claim 4 further comprising a current source coupled to the second end of said second resistor, wherein the current supplied by said current source is provided to the collector of said first transistor and the collector of said second transistor but not to the collector of said third transistor.

6. A low current bias circuit comprising:

a first transistor having an emitter, base, and a collector, the base of said first transistor being connected to the collector of said first transistor;

a second transistor having an emitter, base, and a collector, the base of said second transistor being connected to the collector of said first transistor;

a first resistor having a first end and a second end, the first end of said first resistor being connected to the emitter of said second transistor, the second end of said first resistor being connected to the emitter of said first transistor;

a second resistor having a first end and a second end, the first end of said second resistor being connected to the collector of said second transistor, the second end of said second resistor being connected to the base of said second transistor;

a third transistor having an emitter, base, and a collector, the base of said third transistor being connected to the first end of said second resistor, the emitter of said third transistor being connected to the emitter of said first transistor.

7. The circuit of claim 6 wherein the emitter area of said second transistor is larger than the emitter area of said first transistor.

8. The circuit of claim 7 wherein the current through the collector of said first transistor is substantially the same as the current through the collector of said second transistor.

9. The circuit of claim 6 wherein the emitter area of the second transistor is larger than the emitter area of the first transistor by a factor which offsets the degeneration brought about by the first resistor.

10. The circuit of claim 6 wherein the ratio of the resistance between the first resistor and the second resistor is substantially 1 to 3.

11. The circuit of claim 6 further comprising a current source coupled to the collector of said first transistor.

* * * * *